US005264863A

United States Patent [19]

Miner, Jr. et al.

[11] Patent Number: 5,264,863

[45] Date of Patent: Nov. 23, 1993

[54] MOBILE CYLINDRICAL ANTENNA

[75] Inventors: Harlow J. Miner, Jr., Severna Park; Gary E. Evans, Hanover, both of Md.

[73] Assignee: The United States of America as represented by the Secretary of the Air Force, Washington, D.C.

[21] Appl. No.: 10,961

[22] Filed: Jan. 29, 1993

[51] Int. Cl.[5] ..... H01Q 1/08

[52] U.S. Cl. ..... 343/881; 343/713

[58] Field of Search ..... 343/713, 871, 872, 880, 343/881, 878, 890, 891, 915, 916; 248/166, 435; 52/641, 642

[56] References Cited

U.S. PATENT DOCUMENTS 3,566,346 2/1971 Scopatz ..... 343/881

*Primary Examiner*—Michael C. Wimer
*Assistant Examiner*—Tan Ho
*Attorney, Agent, or Firm*—Stanton E. Collier; Donald J. Singer

[57] ABSTRACT

The mobile cylindrical microwave antenna array of the present invention comprises a plurality of rectangular panels when deployed forming a cylindrical array. The total number of panels forms an even number with each pair of panels, a left panel and a right panel, forming a subarray unit of the cylindrical array. These panels are hinged on the vertical outer edges to each other. The mobile cylindrical array has a center support structure which has a plurality of folding radial supports at the bottom and top of the center support structure. Each subarray unit is attached to the radial supports at the top and bottom. A motorized driver for translating is attached to each subarray unit and one radial support. When operated to collapse the deployed array, the motorized driver causes the left and right panel of the subarray unit to fold outwardly wherein the apex points to the center support. When the panels are fully collapsed against the center support, the radial supports are folded into the collapsed panels thus forming a compact cylindrical package.

8 Claims, 7 Drawing Sheets

MOBILE CYLINDRICAL ANTENNA

STATEMENT OF GOVERNMENT INTEREST

The invention described herein may be manufactured and used by or for the Government for governmental purposes without the payment of any royalty thereon.

BACKGROUND OF THE INVENTION

The present invention relates to microwave antennas, and, more particularly, to microwave antennas that are transportable over the road or by aircraft.

Cylindrical antenna arrays are means for producing agile radar or communication beams that can be steered through 360° of azimuth with constant beam shape. Coincidentally, lower frequency systems are desirable as a means of enhancing small target cross sections. These lower frequencies require very large antennas to achieve adequate gain. The combination of these two requirements, being steerable and having adequate gain, results in cylinder antennas that are much larger than can be transported directly. For example, a 25 foot diameter, 25 foot tall cylinder antenna is a likely antenna configuration. This size is clearly not transportable and the type of connections required preclude the separation of the antenna into separate pieces that could be stacked.

Thus there is a clear need of a mobile microwave cylindrical antenna that is easily transportable.

SUMMARY OF THE INVENTION

The present invention provides a mobile cylindrical microwave antenna that is transportable by road within legal limits and/or by aircraft such as a C-130.

The mobile cylindrical microwave antenna comprises a plurality of rectangular panels when deployed forming a cylindrical array. The total number of panels forms an even number with each pair of panels, a left panel and a right panel, forming a subarray unit of the cylindrical array. These panels are hinged on the vertical outer edges to each other. The cylindrical array has a center support which has a plurality of folding radial supports at the bottom and top of the center support structure. Each subarray unit is attached to the radial supports at the top and bottom. A motorized driver is attached to each subarray unit and one radial support. When operated to collapse the deployed array, the motorized driver causes the left and right panel of the subarray unit to fold outwardly wherein the apex points to the center support. When the panels are fully collapsed against the center support, the radial supports are folded into the collapsed panels thus forming a compact cylindrical package. The deployment and the collapsing of the cylindrical array may be totally automated with appropriate means therein. All electrical connections to the microwave radiators on the panels are permanent. The cylindrical array would further be mounted on a support means which could place the array in a horizontal position for transport.

Therefore, one object of the present invention is to provide a mobile cylindrical microwave antenna.

Another object of the present invention is to provide a mobile cylindrical microwave antenna that is transportable either by road or by aircraft.

Another object of the present invention is to provide a mobile cylindrical microwave antenna that is deployed and collapsed in an almost automated manner.

These and many other objects and advantages of the present invention will be readily apparent to one skilled in the pertinent art from the following detailed description of a preferred embodiment of the invention and the related drawings.

DESCRIPTION OF THE PREFERRED EMBODIMENT

The present invention is a mobile cylindrical microwave antenna array 10 having a possible diameter of about 25 feet and a collapsed diameter of about 8 feet which is easily road or air transportable.

Figure 1:
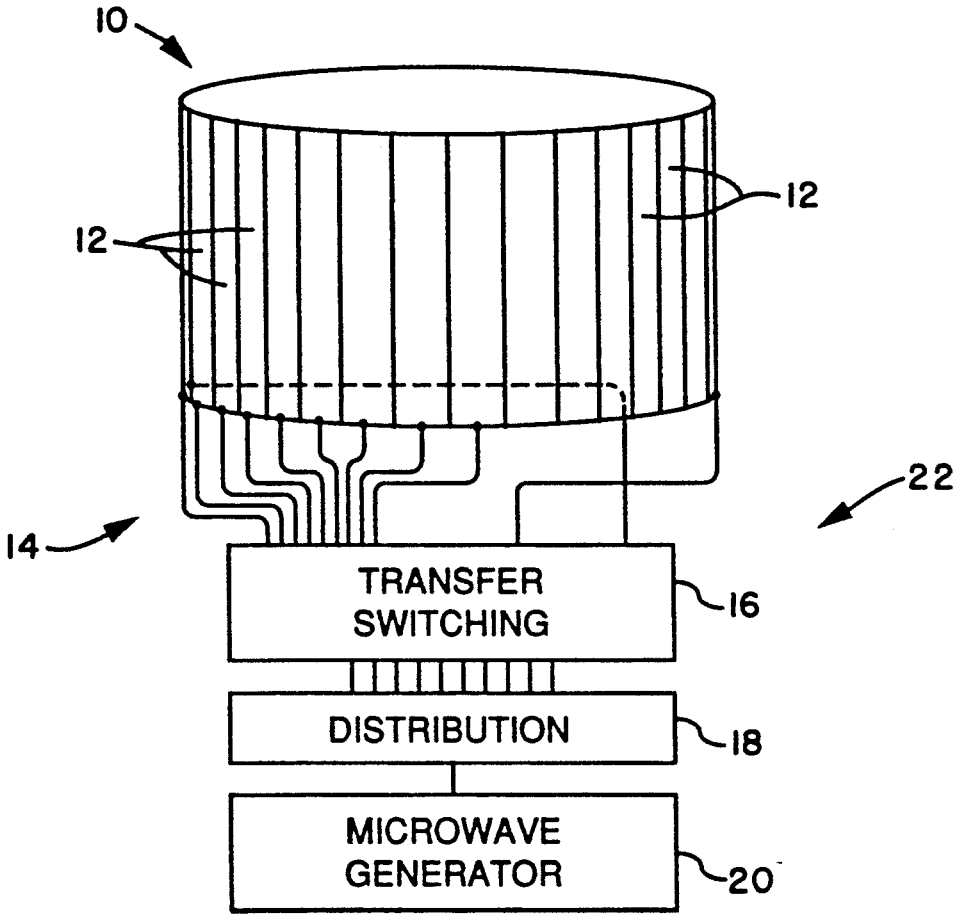
FIG. 1 illustrates the mobile cylindrical microwave antenna array of the present invention with some of the electrical connections thereon.
Figure 2:
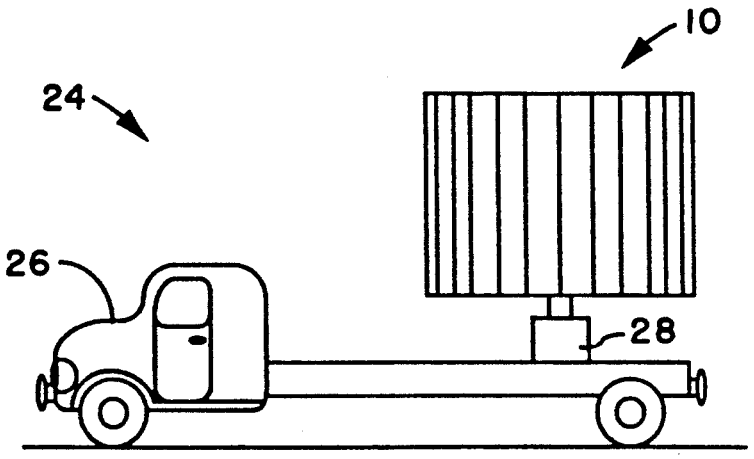
FIG. 2 illustrates the array of the present invention mounted on a truck.

Referring to FIG. 1, the array 10 has a plurality of panels 12 attached to each other and to corporate feed lines 14. The feed lines 14 are connected to transfer switching means 16, distribution means 18 and a microwave generator 20. The array 10 including appropriate circuitry 22 is attached to transporting means 24, FIG. 2, such as a truck 26. The array 10 is attached to an erecting means 28 that is also attached to the truck 26. U.S. Pat. Nos. 3,377,594; 4,771,293 and 3,617,113 are incorporated by reference as to the teachings therein such as the means for erecting an antenna, etc.

Figure 3:
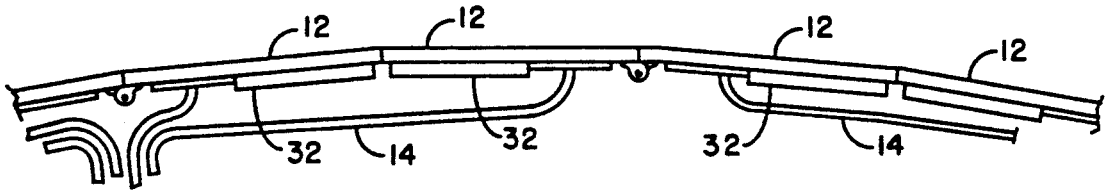
FIG. 3 illustrates by partial top view the panels of the array.

FIG. 3 shows a top view of some of the panels 12 with corporate feed lines 14 being attached to radiating elements 32 being of conventional design for a cylindrical microwave antenna array having vertical radiators.

Figure 4:
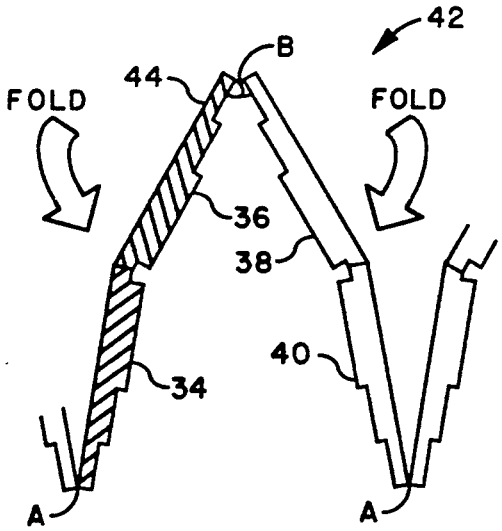
FIG. 4 illustrates the folding of the panels of the present invention.

FIG. 4 illustrates the panels 12 shown in FIG. 3 in a partially folded mode whether being deployed or collapsed to a closed state. As seen in FIG. 4, panels 34, 36, 38 and 40 form a unit subarray 42. The points A are hinged so that the adjacent panels can fold into the fronts of each other and the points B, only one shown, are hinged so that adjacent panels 36 and 38 can fold away from the fronts and into the backs of each other. The difference being defined from a front 44 of each panel. In this embodiment, two panels 34 and 36 stay together. As points A are moved in the direction of a center support structure 46, FIG. 5, panels 36 and 38 pivot about hinge point B with panels 38 and 40. The degree to which the panels can be brought together depends on the thickness and width of the panels. See FIG. 11.

Figure 5:
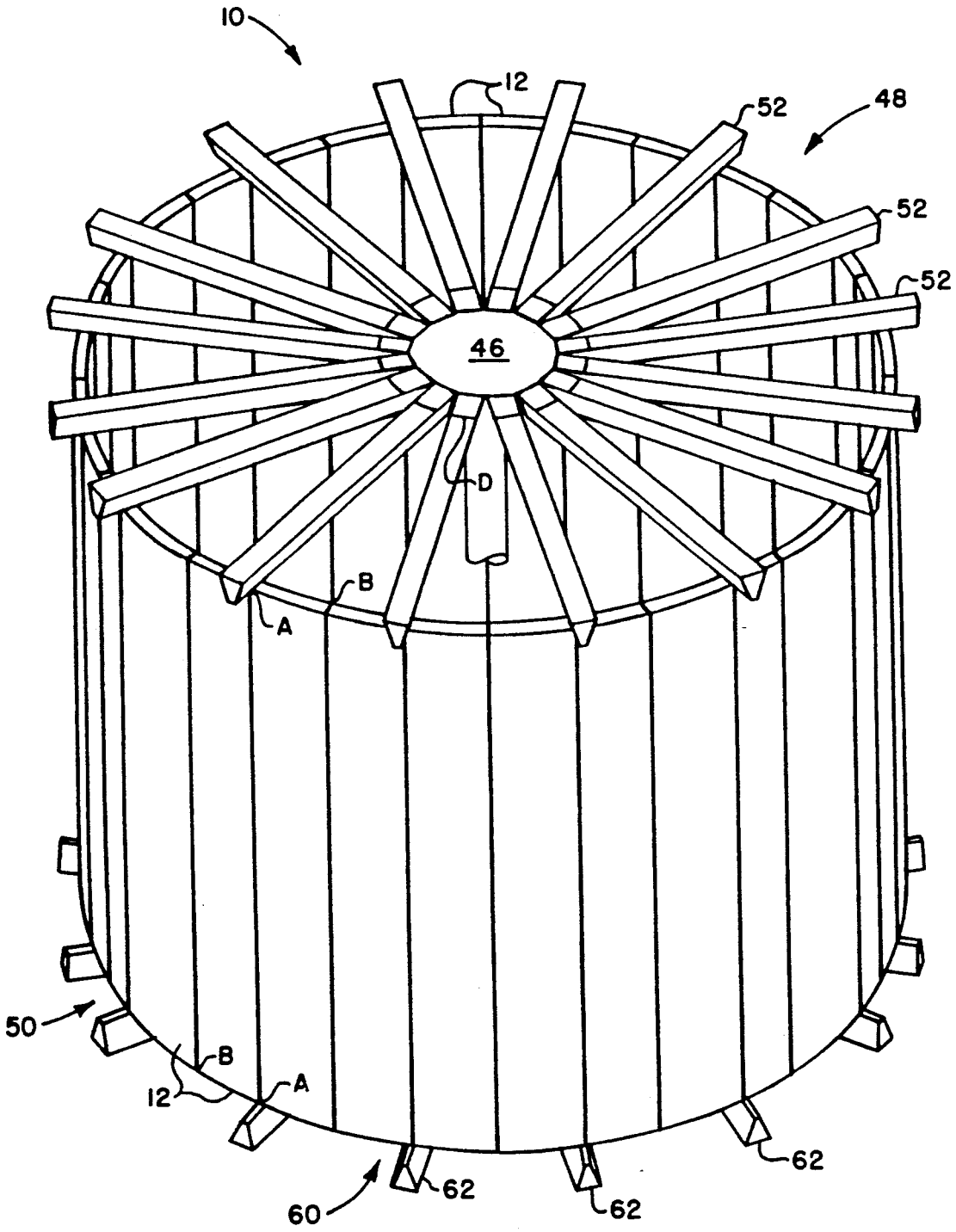
FIG. 5 illustrates by perspective view the antenna array of the present invention in the deployed state.

Referring to FIG. 5, the array 10 is shown in the unfolded condition with the panels 12 being operatively connected to upper radial support means 48 and lower radial support means 50. The upper radial support means 48 comprises a plurality of upper radial support arms 52 which are operatively connected to the center support structure 46. Each arm 52 may be hinged at points D for the reasons to be noted below.

Figure 6:
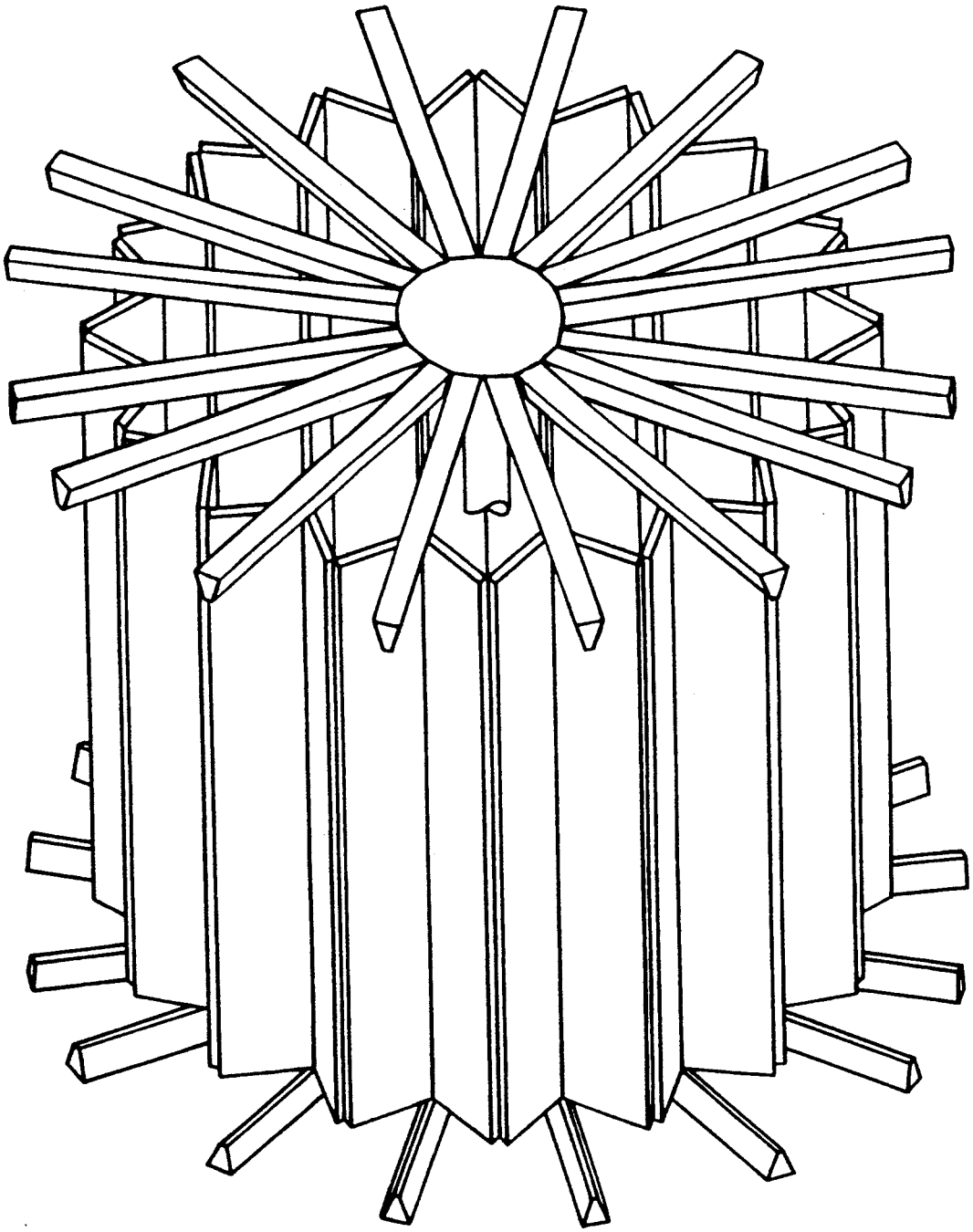
FIG. 6 illustrates by perspective view the antenna array of FIG. 5 being collapsed.
Figure 7:
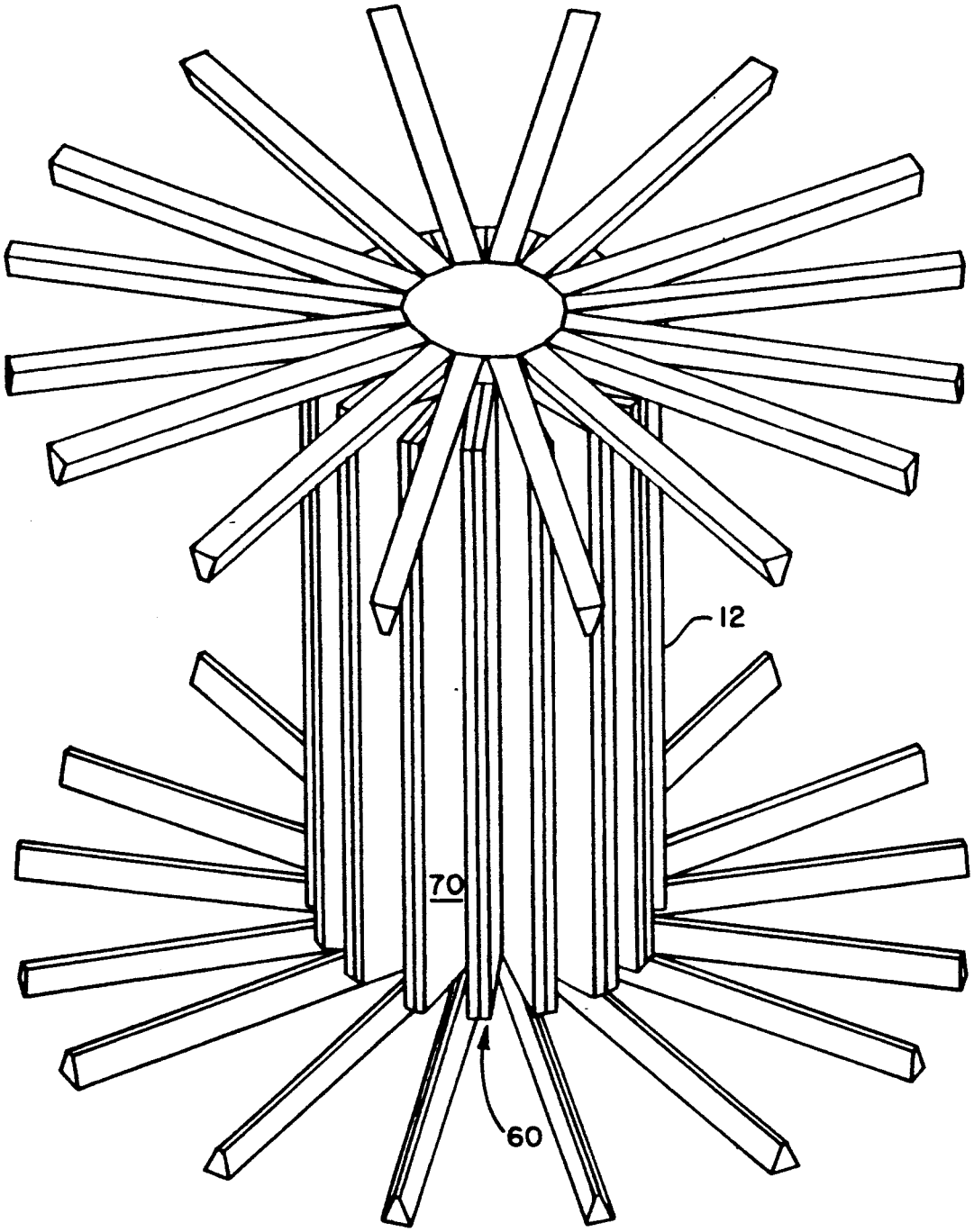
FIG. 7 illustrates by perspective view the antenna array of FIG. 5 being further collapsed than FIG. 6.
Figure 8:
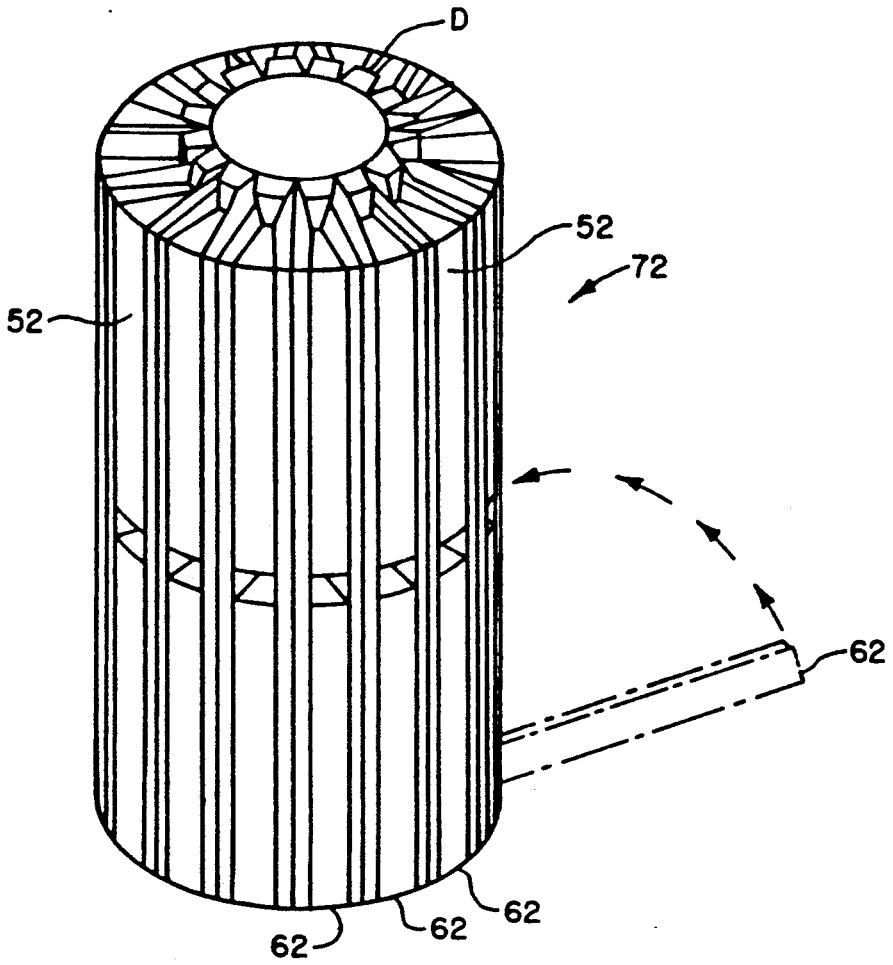
FIG. 8 illustrates by perspective view the antenna array of FIG. 5 being further collapsed than FIG. 7 with the radial support arms folded into the collapsed panels.
Figure 9:
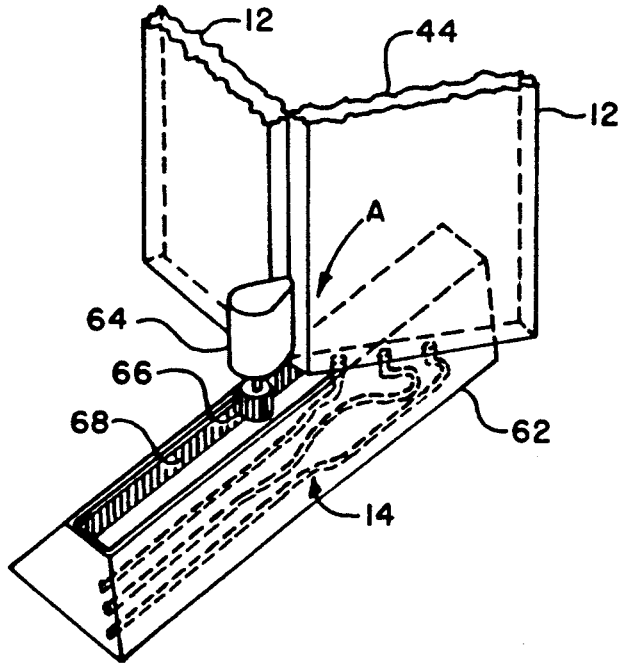
FIG. 9 illustrates the motorized driver for moving the panels of the present invention.
Figure 10:
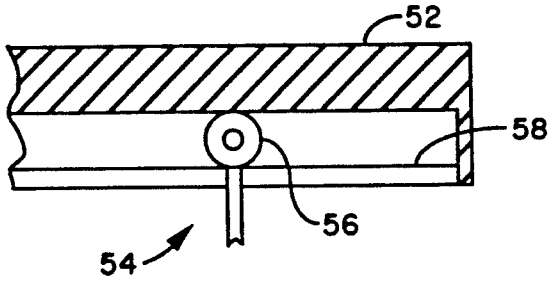
FIG. 10 illustrates a track in a radial support arm.

Further, at each point A and B, FIG. 10, there is attached translating means 54 such as rollers 56 that travel in a track 58. In FIG. 5, the unit subarray 60 is composed of two panels instead of 4. The lower hinge points A of the panels 12 are similarly connected to a plurality of lower radial support arms 62. Further, as seen in FIG. 9, an actuating device such as a gearmotor driver 64 is attached near points A. The driver 64 turns a pinion gear 66 that meshes with a gear rack 68 in the lower radial support arms 62. Other means for unfolding and folding the panels is clearly possible such as a loop cable with a reversible motor attached to the cable and the cable attached to the panels at point A. As further seen in FIG. 9, the corporate feed lines 14 can be placed inside the lower radial support arm for protection and safety. FIG. 6 shows the panels 12 in a partial folded position and FIG. 7 shows the panels 12 completely folded. As seen in FIG. 7, as each subarray 60 folds down, a triangular space 70 remains between the panels of the unit subarray 60. As seen in FIG. 8, each upper radial support arm 52 and lower radial support arm 62 are folded at point D into the space 70 thus forming a compact cylindrical stowed array 72. The folding of these arms can be manually accomplished or automatically, which would require additional hardware.

In further detail, a 25 foot diameter cylindrical array requires approximately 64 panel columns at UHF. The feed lines are connected to the array as seen in FIG. 1 for the purpose of forming an azimuth beam.

Figure 11:
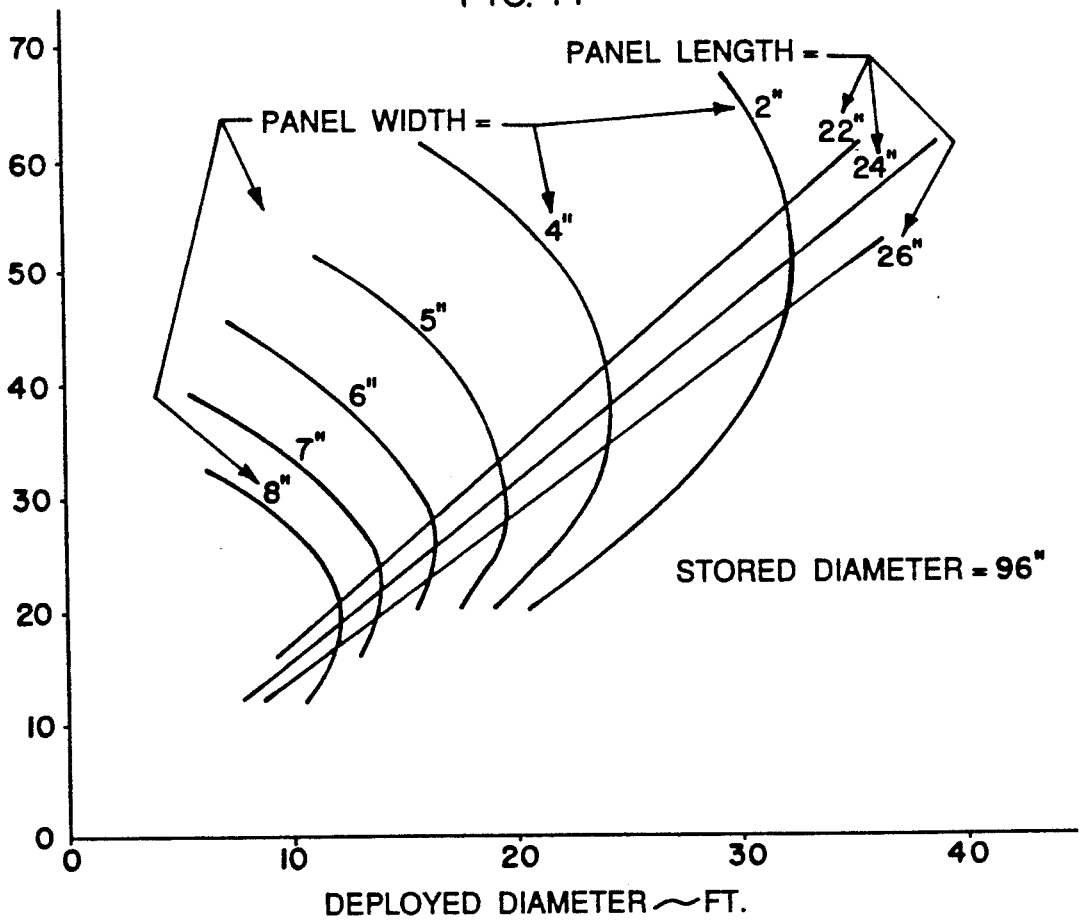
FIG. 11 illustrates by graph the number of panels versus the deployed diameter based on the panel width and length.

It can be shown that the limitation on antenna size is a function of the thickness of the array panels, number of panels and the collapsed diameter limits. The minimum inner collapsed diameter must be large enough to leave room for a center support structure. Once the inner collapsed diameter is determined, the length of each panel is determined based on the collapsed outside diameter limit. The deployed diameter can then be determined based on the length and number of panels. Conversely, the deployed diameter required and the number of panels required can be used to determine the collapsed diameter of the cylinder. FIG. 11 depicts the typical deployment parameters. Typical requirements suggest that there be 60 to 80 radiating columns of radiators in the array. It has been determined that a panel can be constructed that is two columns of radiators wide thus there are one half the number of panels as radiating columns. The preferred number of panels would be divisible by 5 while electrical considerations may require switching columns in 120° steps of a factor of 3 and thus the total number of radiating columns would be divisible by 12.

Clearly, many modifications and variations of the present invention are possible in light of the above teachings and it is therefore understood, that within the inventive scope of the inventive concept, the invention may be practiced otherwise than specifically claimed.

What is claimed is;

1. A mobile cylindrical antenna array, said mobile cylindrical antenna array comprising:

means for attaching said mobile cylindrical antenna to means for transporting said mobile cylindrical antenna;

a center support structure, said center support structure being attached to said means for attaching, said means for attaching being able to place said center support structure in a vertical position;

upper support means, said upper support means being attached to a top of said center support structure, said upper support means comprising a plurality of upper support arms, said upper support arms having hinge means therein for allowing the folding of said upper support arms;

lower support means, said lower support means being attached to a bottom of said center support structure, said lower support means comprising a plurality of lower support arms, said lower support arms having hinge means therein for allowing the folding of said lower support arms, a number of said upper support arms and said lower support arms being equal;

a plurality of panels, said plurality of panels being translatably attached to said upper support arms and said lower support arms, said panels being operatively connected to adjacent panels, said panels when folded forming a compact cylindrical package, said upper support arms and said lower support arms folding into said panels when folded;

translating means operatively connected to said plurality of panels to cause said plurality of panels to move either to or from said center support structure;

electrical means for providing power to said translating means;

microwave radiating elements, said microwave radiating elements attached to said plurality of panels; and means for feeding said microwave radiating elements, said feeding means being connected to said microwave radiating elements.

2. A mobile cylindrical antenna as defined in claim 1 wherein said means for transporting is either by truck or by small cargo plane.

3. A mobile cylindrical antenna as defined in claim 1 wherein said lower support arms have said means for feeding enclosed therein for protection and safety.

4. A mobile cylindrical antenna array as defined in claim 1 wherein said plurality of panels are divided into unit subarrays.

5. A mobile cylindrical antenna array as defined in claim 4 wherein each unit subarray comprises either 2 or 4 panels, each unit subarray being operatively connected to one upper support arm and one lower support arm.

6. A mobile cylindrical antenna array as defined in claim 5 wherein a motorized driver is operatively connected to each unit subarray and to said support means for causing said panels to be deployed or collapsed.

7. A mobile cylindrical antenna array as defined in claim 1 wherein said microwave radiating elements having a plurality of microwave radiating each microwave radiating section comprises a column of radiators, and each panel has either 1 or 2 radiating sections therein.

8. A mobile cylindrical antenna array as defined in claim 1 wherein said cylindrical package is approximately 25 feet long and about 8 feet in diameter.

* * * * *